US007731380B2

(12) United States Patent
Wu

(10) Patent No.: US 7,731,380 B2
(45) Date of Patent: Jun. 8, 2010

(54) WEAPON MOUNT TACTICAL LIGHT TRIGGER

(76) Inventor: Chris Wu, 1F., No. 34, Alley 6, Lane 104, Ansiang Rd., Sindian City, Taipei County (TW) 231

( * ) Notice: Subject to any disclaimer, the term of this patent is extended or adjusted under 35 U.S.C. 154(b) by 134 days.

(21) Appl. No.: 11/869,748

(22) Filed: Oct. 10, 2007

(65) Prior Publication Data

US 2008/0253110 A1 Oct. 16, 2008

(51) Int. Cl.
*F41G 1/34* (2006.01)
*F41G 1/00* (2006.01)

(52) U.S. Cl. ..... 362/113; 362/110; 362/114; 42/146; 42/114

(58) Field of Classification Search ..... 362/110–114, 362/205–206; 42/146, 114
See application file for complete search history.

(56) References Cited

U.S. PATENT DOCUMENTS 4,777,754 A * 10/1988 Reynolds, Jr. ..... 42/117
5,628,555 A * 5/1997 Sharrah et al. ..... 362/114
6,276,088 B1 * 8/2001 Matthews et al. ..... 42/1.03
6,609,810 B2 * 8/2003 Kim ..... 362/110
6,622,416 B2 * 9/2003 Kim ..... 42/146
6,675,521 B1 * 1/2004 Kim ..... 42/114
6,994,449 B2 * 2/2006 Kim ..... 362/190
7,188,978 B2 * 3/2007 Sharrah et al. ..... 362/396
7,325,352 B2 * 2/2008 Matthews et al. ..... 42/85
2006/0242882 A1 * 11/2006 Liu ..... 42/146

* cited by examiner

*Primary Examiner*—Jacob Y Choi
*Assistant Examiner*—David J Makiya
(74) *Attorney, Agent, or Firm*—Ding Yu Tan

(57) ABSTRACT

A weapon mount tactical light trigger includes a mount for Picatinny rail to clamp to a shotgun or rifle, a light mount to clamp a tactical light, and a principle mount to joint both mounts with a trigger base fixed at the back. Components of the trigger base include a trigger to switch on/off the tactical light, a circular shaft to allocate the trigger on the trigger base and a fixing bolt to keep the trigger and switch of the light to stay connected under normal conditions. When a user presses the trigger with a finger, the trigger pivots on the circular shaft and exerts pressure to the switch of the tactical light. The structure design of the trigger base is according to the principle of leverage; via pressing the trigger, it exerts pressure to the switch to turn on/off the light; as the mechanism design of this creation avoids possible shortfall of wire conduction and enhance the performance stability of the tactical light.

6 Claims, 4 Drawing Sheets

WEAPON MOUNT TACTICAL LIGHT TRIGGER

BACKGROUND OF THE INVENTION

1) Field of the Invention

The present invention relates to a weapon mount tactical light trigger. More particularly, the invention relates to a weapon mount using trigger mechanism to activate the tactical light of a shotgun or rifle.

2) Description of the Prior Art

A tactical light is an accessory of shotgun or rifle and is turned on/off by pressing a pressure pad on a tail-cap switch. The pressure pad is attached to a tactical grip with a hook and loop fastener and turned on by palm.

As the tail-cap switch employs an electro-mechanism and there is a section of the wire between the switch and light exposed outside of the gun, the wire is prone to damages to cause the tail-cap switch and tactical light failure.

SUMMARY OF THE INVENTION

The main purpose of the present invention of a weapon mount tactical light trigger is to provide a weapon mount that adopts a trigger-activated tactical light. The invention provides not only its basic function of connecting the gun and light but also a different way of switching on/off the light with a trigger mechanism. This installation offers a reliable solution as it avoids possible damages to the exposed wire between the tail-cap switch and tactical light.

The weapon mount tactical light trigger includes a mount for a Picatinny rail to clamp to a Picatinny rail of a shotgun or rifle, a light mount to clamp a tactical light, and a principal mount to clamp both mounts above. The principal mount is attached with a trigger base which has an operable trigger to turn on/off the tactical light switch, a circular shaft to fix the trigger to the trigger base with a sliding coordination, and a fixing bolt to keep the trigger stay connected with the switch when in use. When the principal mount is clamped to the Picatinny rail with the mount for Picatinny rail and the tactical light is installed to the light mount, the tactical light is turned on/off by pressing the trigger of the trigger base and the trigger will pivot on a circular shaft to give pressure to the switch at the end of the tactical light.

Since the mechanical design of the weapon mount tactical light trigger combines the principal mount and trigger, it is possible to avoid drawbacks of the exposed wire as when using a tail-cap switch to ensure performance stability of the tactical light.

According to the above illustration, the only requirement at setting up a tactical light with the weapon mount tactical light trigger is to replace the traditional tactical light mount with the present invention, and omit the use of a tail-cap switch to improve the stability while avoiding such situation as unable to turn on/off the light.

DETAILED DESCRIPTION OF THE INVENTION

Figure 1:
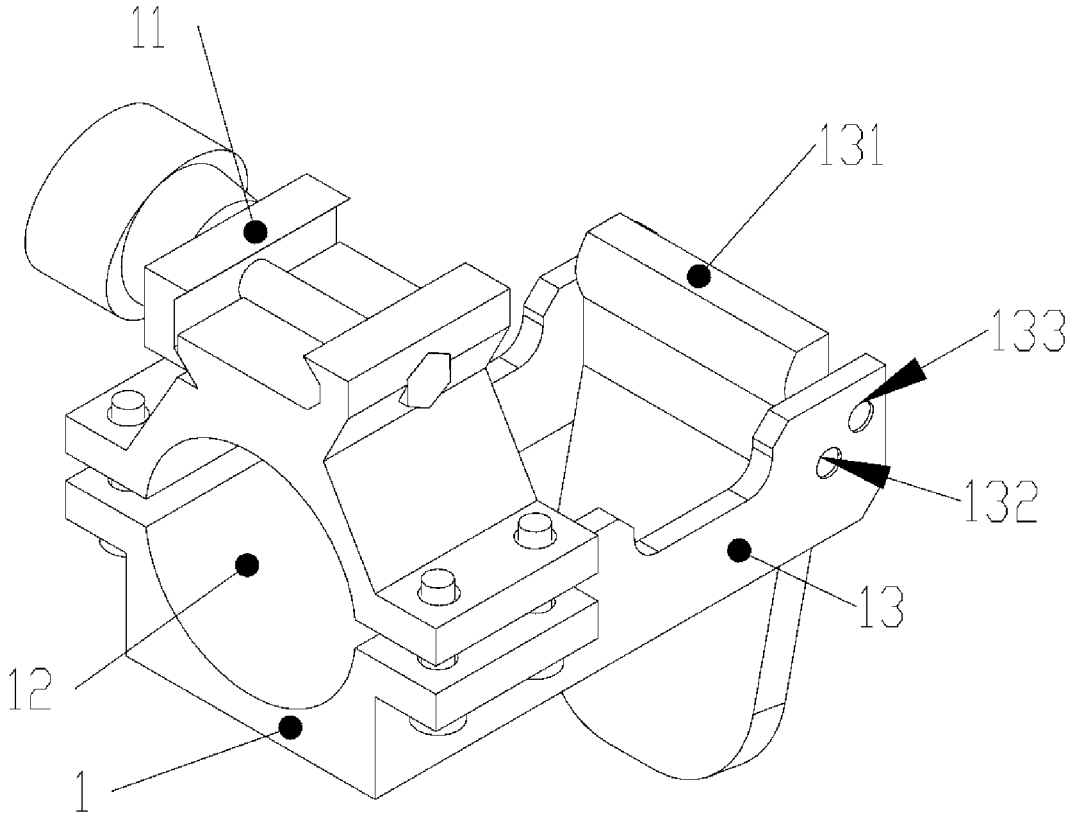
FIG. 1 is a 3 dimensional component assembly drawing of an embodiment of the present invention of a weapon mount tactical light trigger.

FIG. 1 shows a 3 dimensional component assembly drawing and

Figure 2:
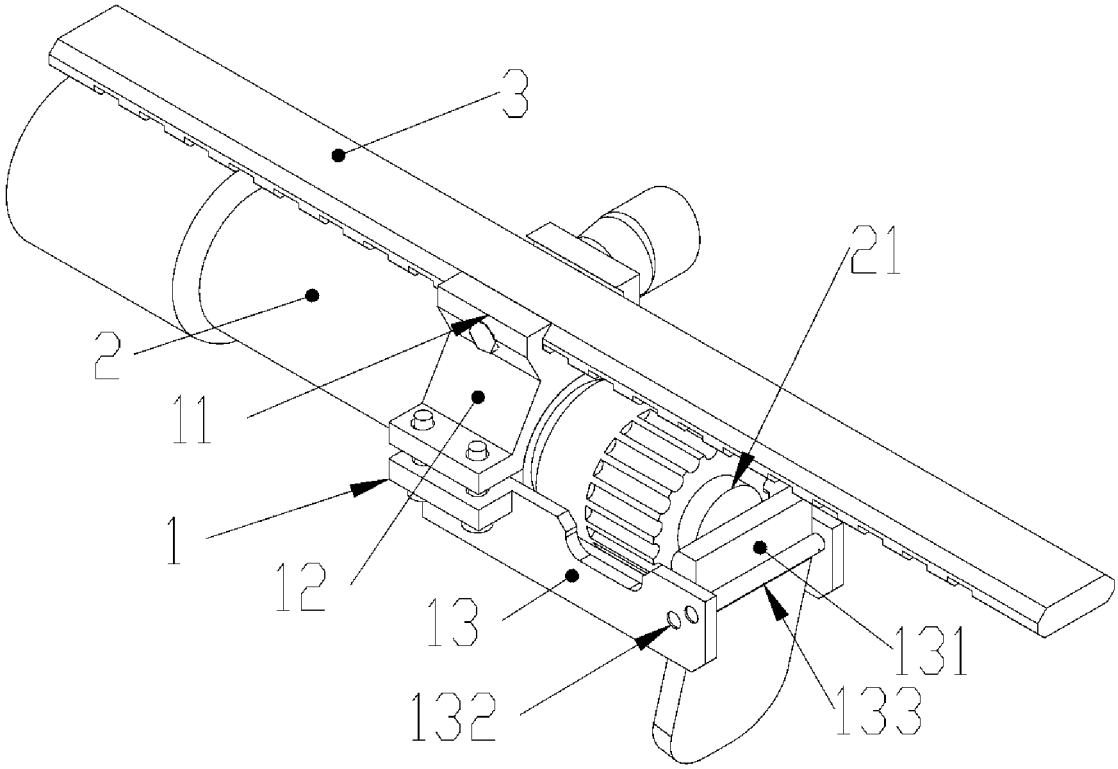
FIG. 2 is a reference drawing of components of the embodiment of the present invention of a weapon mount tactical light trigger.

FIG. 2 shows a reference drawing of the components of a weapon mount tactical light trigger according to the embodiment of the present invention. As illustrated in FIGS. 1 and 2, the tactical light mount trigger shall include a principal mount (1), comprising of a mount for a Picatinny rail (11), a light mount (12) and a trigger base (13); more particularly, the trigger base (13) is installed with a trigger (131), a circular shaft (132) and a fixing bolt (133). Wherein the above, the mount for the Picatinny rail (11) is to clamp the principal mount (1) to the Picatinny rail (3), the light mount (12) is to clamp the tactical light (2) and, the trigger base (13) is used to join the principal mount (1) and trigger (131); furthermore, the way/method to join the trigger base (13) and principal mount (1) is to form them into one piece such as by casting, forging or other possible methods. A purpose of the trigger (131) is to turn on/off the switch (21) at the end of the tactical light (2). The circular shaft (132) is to combine the trigger (131) and trigger base (13). The trigger (131) is movable with a fixing bolt (133) positioned at the back to maintain the trigger (131) and the switch (21) connected.

Figure 3:
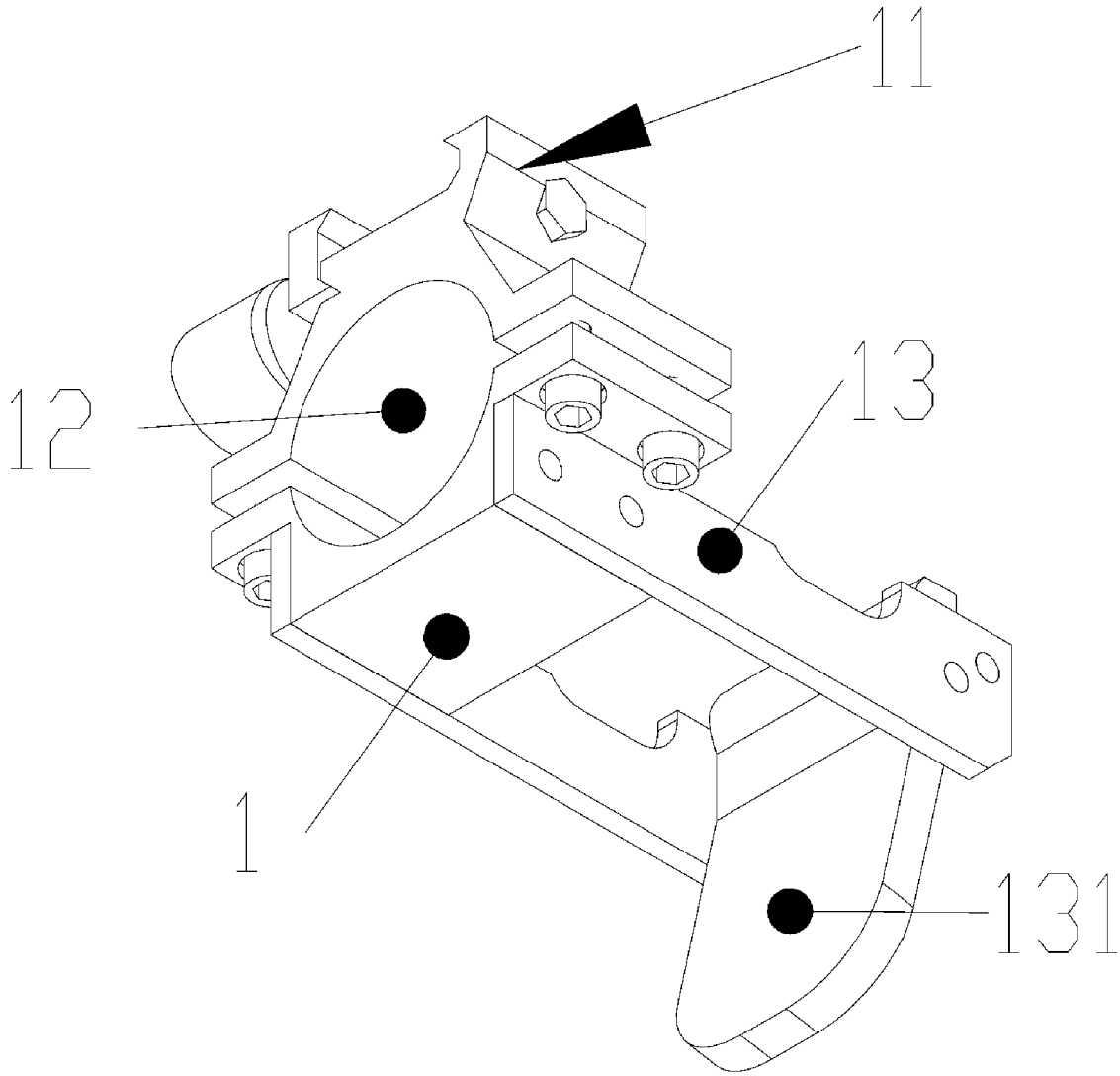
FIG. 3 is a 3 dimensional component assembly performance drawing of the embodiment of the present invention of a weapon mount tactical light trigger.

FIG. 3 shows a 3 dimensional component assembly performance drawing of the weapon mount tactical light trigger of the embodiment of the present invention, as illustrated, the trigger base (13) is demountable.

Figure 4:
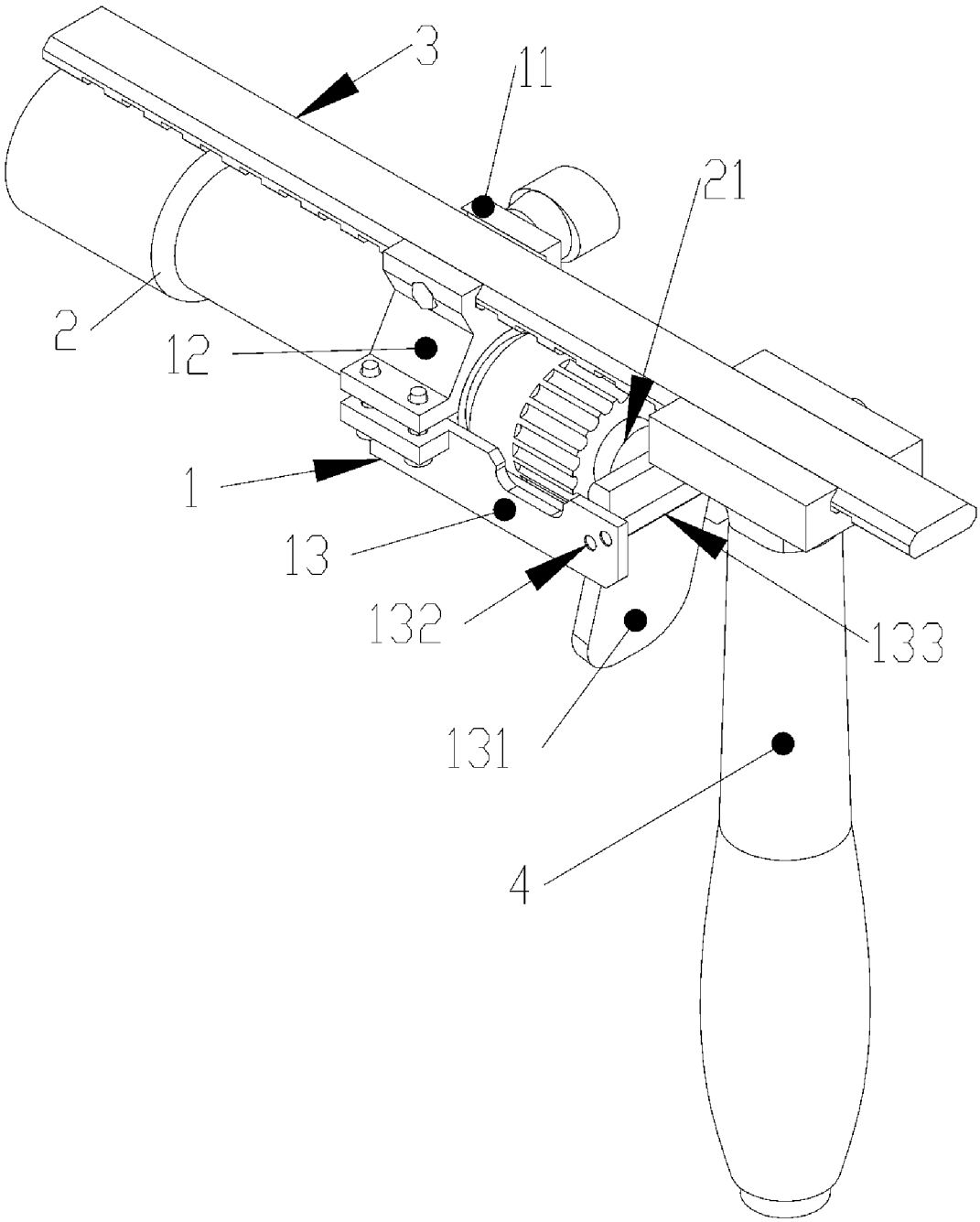
FIG. 4 is a reference drawing for operations of the embodiment of the present invention of a weapon mount tactical light trigger.

FIG. 4 shows a reference drawing for operations of the weapon mount tactical light trigger of the embodiment of the present invention, as illustrated, the default position of its principal mount (1), tactical light (2), Picatinny rail (3), and tactical grip (4) are located respectively on a shotgun or rifle. The key here is that the tactical grip (4) is located behind the trigger (131) and when a user is holding the tactical grip (4), he/she only needs to stretch a finger to pull the trigger (131) to turn on the switch (21) of the tactical light (2).

As the mechanical design of the weapon mount tactical light trigger comprises of the principal mount (1) and trigger (131), the switch (21) can be turned on/off directly and avoids possible failure with a tail-cap switch and enhances performance stability of the tactical light (2).

It is of course to be understood that the embodiment described herein is merely illustrative of the principles of the invention and that a wide variety of modifications thereto may be effected by persons skilled in the art without departing from the spirit and scope of the invention as set forth in the following.

The invention claimed is:

1. A weapon mount tactical light trigger is comprised of a principal mount that includes a mount for Picatinny rail to clamp the principal mount to a Picatinny rail of a rifle or shotgun, a light mount to clamp a tactical light, and a trigger base to position a trigger on the principal mount; this trigger base comprises of the trigger to activate a tactical light switch, a circular shaft to assemble the trigger to the trigger base, and a fixing bolt established in the backside of the trigger to keep the trigger and switch remain connected when use under normal conditions; when the mount for Picatinny rail clamps the weapon mount tactical light trigger to the Picatinny rail of the firearm, and the light mount clamps the tactical light, then the trigger which is at the end of the tactical light switch is ready to operate; wherein the trigger pivots on the circular shaft as the circular shaft is a fulcrum to lever the trigger, while the bottom end of the trigger is pressed, the trigger shall rotate about the circular shaft, and then the top end of the trigger shall press the tactical light switch, and the tactical light shall be turned on.

2. The weapon mount tactical light trigger according to claim 1, wherein the trigger base and principal mount can be formed together or jointed by any mechanism method so that they can be connected at all times.

3. The weapon mount tactical light trigger according to claim 2, wherein the trigger base is demountable and may be assemble or disassemble from the principal mount.

4. The weapon mount tactical light trigger according to claim 1, wherein the trigger is united with the trigger base via a circular shaft which cleaves the trigger and trigger base.

5. The weapon mount tactical light trigger according to claim 1, wherein the method of joining the principal mount and the mount for Picatinny rail includes method for forming these two elements into one piece.

6. The weapon mount tactical light trigger according to claim 1, wherein the method of joining the principal mount and the light mount includes for forming these two elements into one piece.

* * * * *